US006536694B2

(12) United States Patent
Van Mullem

(10) Patent No.: US 6,536,694 B2
(45) Date of Patent: Mar. 25, 2003

(54) GYRATORY CRUSHER SPIDER GUARDS

(75) Inventor: Albert J. Van Mullem, Sussex, WI (US)

(73) Assignee: Sandvik AB, Sandviken (SE)

( * ) Notice: Subject to any disclaimer, the term of this patent is extended or adjusted under 35 U.S.C. 154(b) by 5 days.

(21) Appl. No.: 09/755,431

(22) Filed: Jan. 5, 2001

(65) Prior Publication Data

US 2002/0088888 A1 Jul. 11, 2002

(51) Int. Cl.[7] ..... B02C 2/06
(52) U.S. Cl. ..... 241/210
(58) Field of Search ..... 241/207–216

(56) References Cited

U.S. PATENT DOCUMENTS

| | | | | |
|---|---|---|---|---|
| 3,924,815 | A | | 12/1975 | Haggren |
| 4,065,064 | A | * | 12/1977 | Anthony ..... 241/182 |
| 4,179,076 | A | | 12/1979 | Barrot et al. |
| 4,384,684 | A | | 5/1983 | Karra |
| 4,410,143 | A | | 10/1983 | Polinski |
| 4,467,971 | A | | 8/1984 | Schuman |
| 4,478,373 | A | | 10/1984 | Gieschen |
| 4,519,551 | A | | 5/1985 | Ceurvorst |
| 4,659,026 | A | | 4/1987 | Krause et al. |
| 4,750,679 | A | | 6/1988 | Karra et al. |
| 5,022,593 | A | | 6/1991 | Stelk |
| 5,031,843 | A | | 7/1991 | Motz |
| 5,080,294 | A | | 1/1992 | Dean |
| 5,372,318 | A | | 12/1994 | Jacobson |
| 5,769,340 | A | | 6/1998 | Jean |
| 5,775,607 | A | | 7/1998 | Bayliss et al. |
| 5,803,382 | A | | 9/1998 | Ganser, IV et al. |
| 5,810,269 | A | | 9/1998 | Shannon |
| 5,915,638 | A | | 6/1999 | Jean |
| 5,934,583 | A | | 8/1999 | Jean |
| 5,938,133 | A | | 8/1999 | Bayliss et al. |
| 5,944,265 | A | | 8/1999 | Ganser, IV et al. |
| 5,964,422 | A | | 10/1999 | Ruokonen et al. |
| 5,996,916 | A | | 12/1999 | Musil |
| 6,007,009 | A | | 12/1999 | Sheridan et al. |

* cited by examiner

*Primary Examiner*—Mark Rosenbaum
(74) *Attorney, Agent, or Firm*—Burns, Doane, Swecker & Mathis, LLP

(57) ABSTRACT

A gyratory crusher uses a new spider arm guard and rim liner arrangement. The spider arm guard and rim liner are retained on the spider by means of a dowel and recess system.

19 Claims, 4 Drawing Sheets

GYRATORY CRUSHER SPIDER GUARDS

FIELD OF THE INVENTION

This invention relates to rock crushing systems, such as conical rock crushers or gyratory crushers. Specifically, this invention relates to protective covers, such as spider arm guards and rim liners, utilized in rock crushing systems.

BACKGROUND OF THE INVENTION

Gyratory rock crushers generally have a downwardly expanding central conical member which rotates or gyrates within an outer upwardly expanding frustroconically shaped member typically called a shell. The shell can be comprised of two or more pieces, e.g., a top shell and a bottom shell. The central conical member generally has a wearing cover or a liner called a mantle. A spider assembly rests on the top shell, forming the top of the support structure for the machine. This spider assembly can include spider arm guards. Because the material to be crushed is dropped into the top of the machine, the arms and rim of the spider assembly are subject to a great deal of wear as rocks make impact. Therefore, the spider arm guards and rim liners are used on top of the spider assembly to protect the arms and rim from the falling material. These guards are replaced from time to time when warranted by the amount of degradation.

Spider arm guards and rim liners are generally affixed to the spider assembly with fastening devices. For example, conventional gyratory rock crushers utilize bolts and sometimes springs to maintain the spider arm guards in place over the spider arms. When the guards require replacement, the fastening devices must be removed, which requires substantial labor and machine down-time. Therefore, it would be advantageous to have guards which can be easily affixed and removed from the spider assembly. Thus, there is a need for spider arm guards and rim liners that are easy to install. Further, there is a need for spider arm guards and rim liners that do not require expensive fasteners or fasteners which are difficult to remove.

SUMMARY OF THE INVENTION

The present invention relates to a gyratory rock crusher including a shell and a spider having spider arm guards. The spider arm guards have mounting means that are received in recesses or apertures in the spider arms.

The invention further relates to a spider arm guard for use with the spider arm of a gyratory crusher. The spider arm guard has a shield portion and a number of mounting pegs. The mounting pegs are sized to fit into corresponding recesses or apertures in the spider arm.

The present invention further relates to a gyratory crusher including a shell, a spider with spider arms, spider arm guards, and an attachment system for the spider arm guards. The attachment system includes mounting pegs and recesses or apertures sized to receive the mounting pegs.

Furthermore, the present invention relates to a method of assembling or repairing a rock crusher including placing a spider arm guard over a spider arm, aligning the mounting pegs of the spider arm guard with corresponding recesses or apertures in a spider arm, and lowering the spider arm guard onto the spider arm.

The present invention further relates to a gyratory crusher including a shell, a spider supported by the shell, the spider having a spider rim, a number of rim liner segments mounted on top of the spider rim, and mounting means extending outward from each of the rim liner segments and being received in recesses or apertures in the spider rim.

The present invention still further relates to a rim liner for use with a gyratory crusher including a spider, the rim liner including a shield portion shaped to protect the spider, and a number of mounting pegs extending from the shield portion, wherein the mounting pegs are sized to fit into corresponding recesses or apertures on the spider.

BRIEF DESCRIPTION OF THE DRAWINGS

Exemplary embodiments will hereafter be described with reference to accompanying drawings, wherein like numerals denote like elements.

DETAILED DESCRIPTION OF THE PREFERRED EMBODIMENTS

Figure 1:
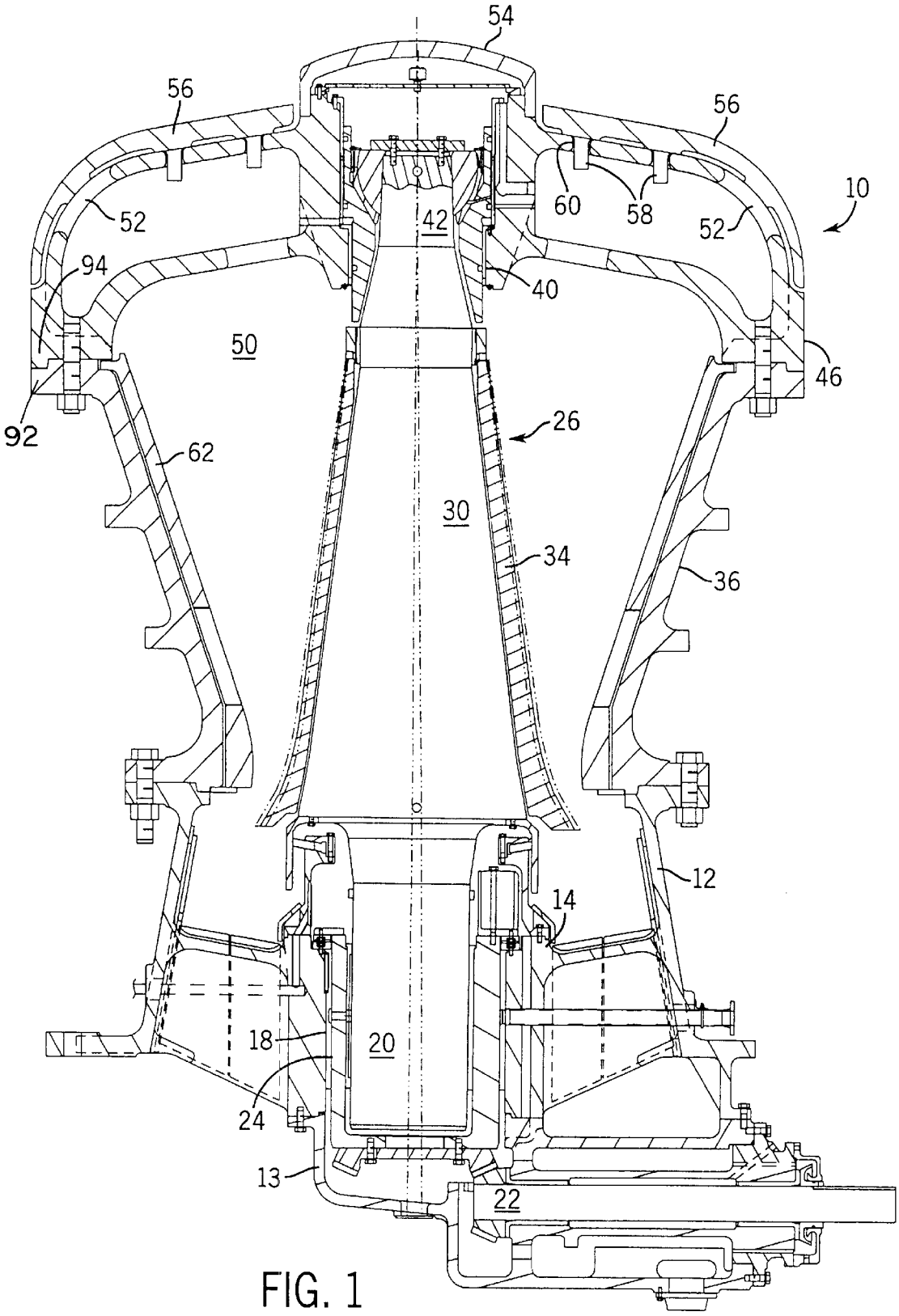
FIG. 1 is a vertical cross-sectional view of a gyratory crusher.

Referring to FIG. 1, a gyratory crusher 10 can be utilized to crush rock, ore, minerals, waste, or other material. Gyratory crusher 10 is assembled on a cast steel base or bottom shell 12 having a central hub 14. Central hub 14 is provided with a vertical bore 18 adapted to receive cylindrical support shaft 20 and eccentric 24. Drive housing 13 extends outwardly from hub 14 to enclose a drive mechanism 22. Drive mechanism 22 causes rotation of an eccentric 24 that directs the gyratory motion of the shaft 20.

A head assembly 26, which is part of the shaft 20, includes a head member 30 which is covered by a mantle 34. Mantle 34 provides one of the crushing surfaces of crusher 10.

A top shell 36 projects upwardly from bottom shell 12 and is covered by a spider assembly including a spider 46. Alternatively, top shell 36 and bottom shell 12 can be a single piece component. Spider 46 includes an aperture 40 that receives an end 42 of shaft 20.

Top shell 36 is protected from wear by several rows of concaves 62. Spider 46 can be attached or rest upon top shell 36. Preferably top shell 36 includes a recessed portion 92 for receiving a flange 94 of spider 46. Vertical positioning of shaft 20 with respect to top shell 36 adjusts the relative position of the mantle 34 of the head assembly 26 with respret to the canvas 62, thereby adjusting the size of the crushed material exiting crusher 10.

Material to be crushed is supplied through spider 46 which includes openings 48 (shown in FIG. 2) for entry of the material into crushing cavity 50. A liquid flush apparatus (not shown) may be provided for spraying a liquid such as water toward the crusher cavity 50.

Figure 2:
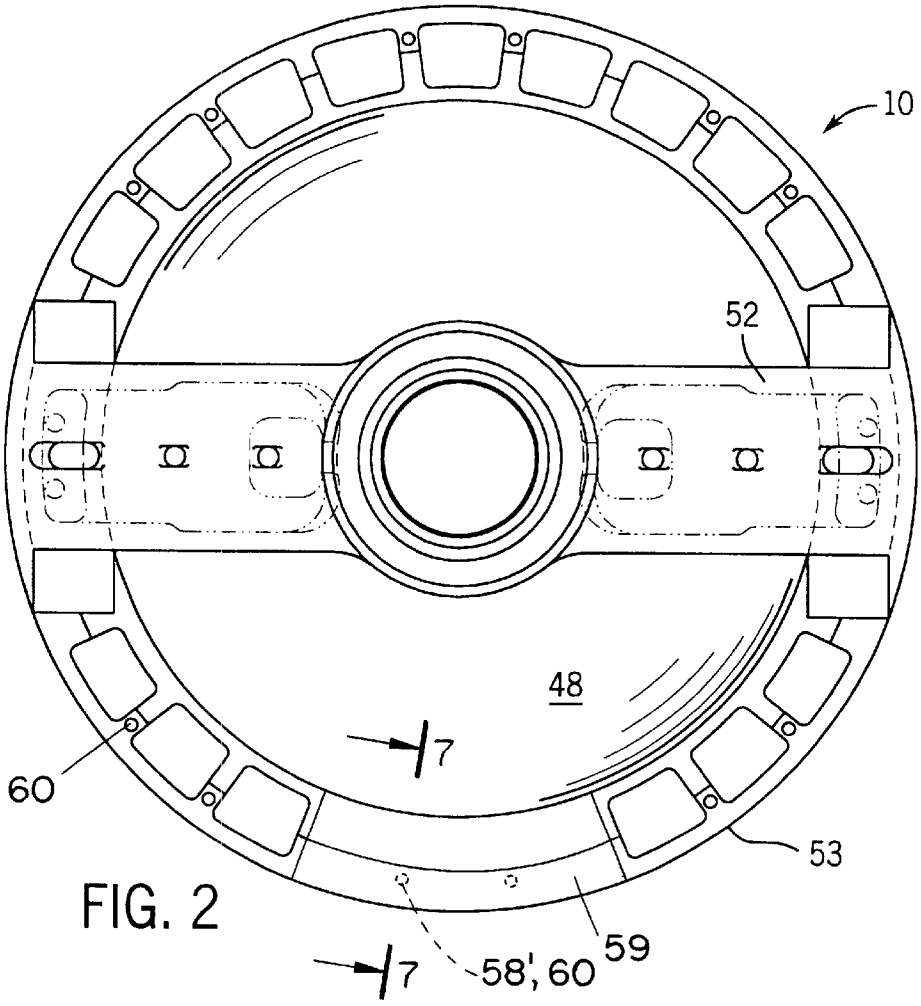
FIG. 2 is a top view of the gyratory crusher showing a spider assembly without spider arm guards.

The spider 46 is comprised of spider arms 52 radially extending outward from the center to spider rim 53 (shown in FIG. 2). A spider cap 54 sits on the top center of the spider 46. Each of the spider arms 52 is protected from falling material by a spider arm guard 56. The spider rim 53 is protected by a rim liner 57 (shown in FIGS. 4 and 5), also known as a hopper liner.

The gyratory crusher 10 operates as follows. When the drive mechanism 22 is driven by any appropriate means, it transmits power to the eccentric 24. The eccentric 24 causes the gyration of the head assembly 26, resulting in the crushing of the material in the crushing chamber 50. The phantom lines flanking the mantle and center axis on FIG. 1 indicate the range of gyratory motion.

FIG. 2 shows the gyratory crusher 10 from the top. In this particular embodiment, there are two spider arms 52 extending from the center. As material is dumped into the machine through openings 48, some of the material impacts the spider 46, requiring the spider arm guards 56 shown in FIGS. 1 and 3.

Figure 3:
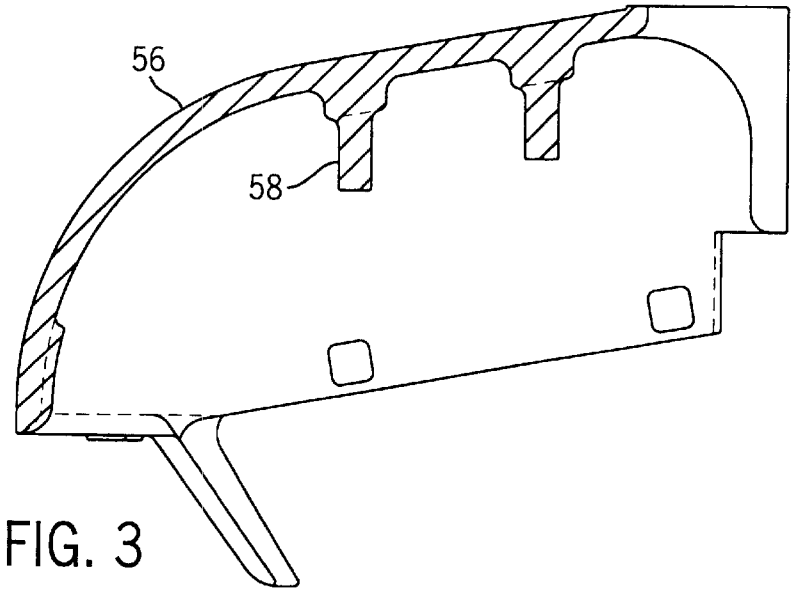
FIG. 3 is a partial cross-sectional view of a spider arm guard.

FIG. 3 is a more detailed cross-sectional view of a spider arm guard 56. In a preferred embodiment, the spider arm guard 56 rests on spider arm 52 and is restrained laterally by means of two mounting pegs 58. The mounting pegs 58 fit into corresponding recesses 60 (shown in FIG. 1) in the spider arm 52. The mounting pegs 58 serve to maintain the spider arm guard 56 in place on the spider arm 52. Each recess 60 can be any aperture that will retain the mounting peg 58.

Figure 4:
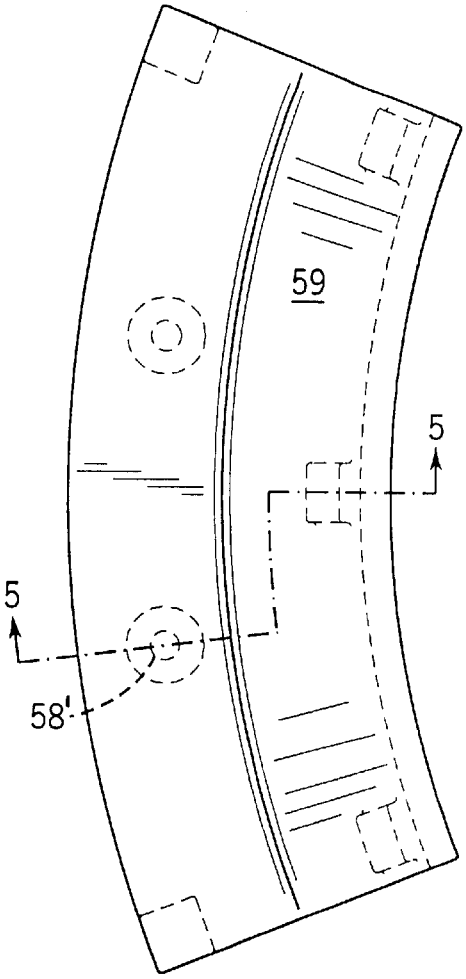
FIG. 4 is a top view of a segment of a spider rim showing a spider rim liner.
Figure 5:
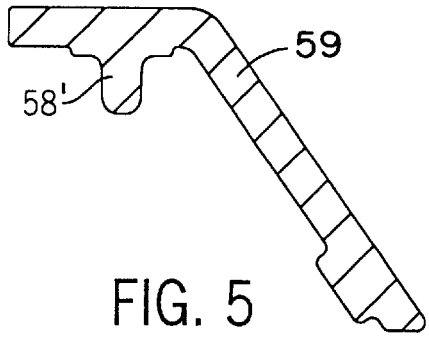
FIG. 5 is a cross-sectional view of a rim liner segment showing a mounting peg.
Figure 7:
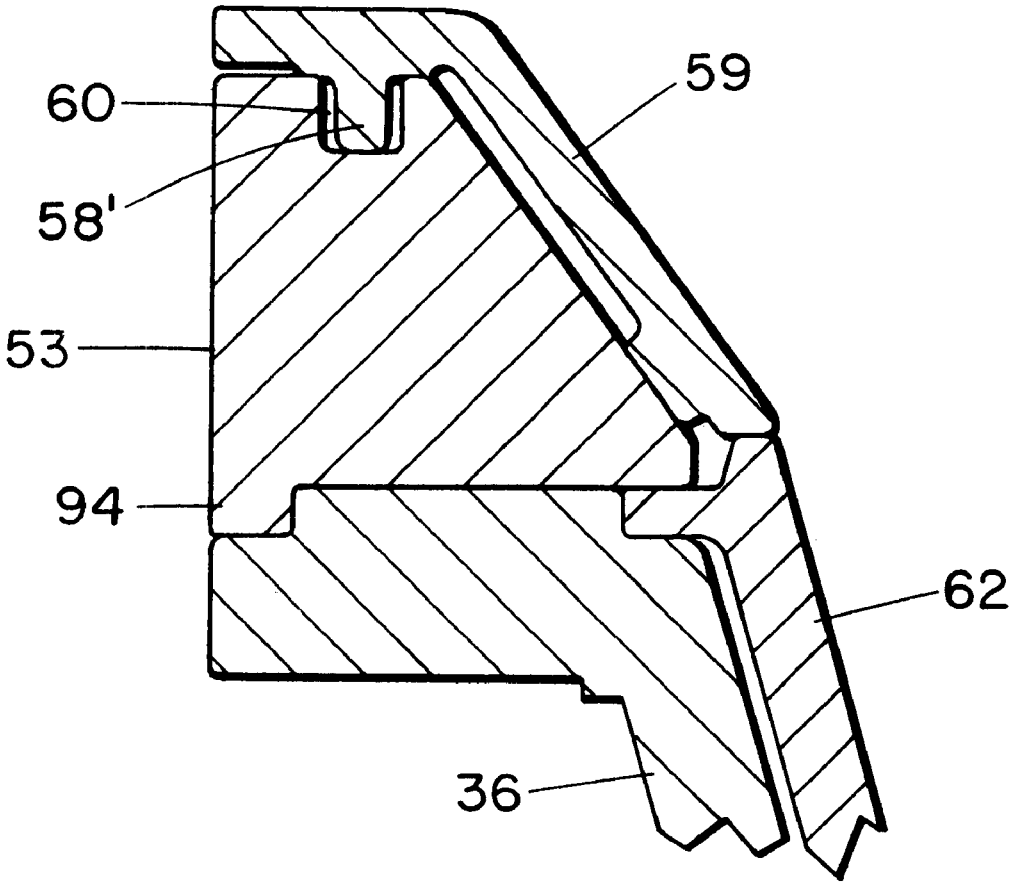
FIG. 7 is a cross-sectional view taken along line 7—7 in FIG. 2.

FIG. 4 shows a segment 59 of a rim liner from a top view. The rim liner is comprised of several curvilinear segments 59 covering the 360 degree arc of the outer peripheral annular rim 53. In the preferred embodiment, the rim liner has an inner radius of about 65 inches and an outer radius of about 86 inches. The rim liner segment is preferably made of a manganese alloy steel. A preferred embodiment has six rim liner segments 59, one of which being shown installed in FIG. 2. The locations of two mounting pegs 58' are shown. A cross-section of this rim liner segment is shown in FIG. 5, the plane including a mounting peg 58'. FIG. 7 shows one rim liner segment 59 mounted in place.

Figure 6:
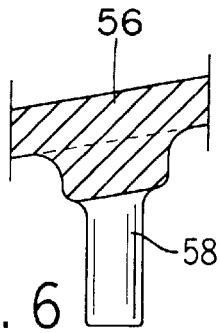
FIG. 6 is a cross-sectional view of the mounting peg.

FIG. 6 shows a mounting peg 58 for a spider arm guard 56 in even more detail. The mounting pegs 58 are designed with the following considerations in mind. The length must be sufficient to allow some vertical motion due to machine vibration without the guard 56 becoming dislodged. In the preferred embodiment, the mounting pegs 58 are about 7.2 inches in length and 3.2 inches in diameter when used on a spider arm guard 56. The preferred size of mounting pegs 58 when used in a rim liner is about two inches in diameter and 2.8 inches in length. It is preferred to cast the mounting pegs 58 integrally with the spider arm guard 56 to avoid a possible weakness in the joint between the mounting peg 58 and the guard 56. Although the shape of the spider arm guard 56 helps keep the guard 56 in place, pegs 58 and recesses 60 are necessary to provide a fastening or mounting system that maintains the placement of the arm guard 56 with respect to spider arm 52.

Each spider arm guard 56 may have a number of mounting pegs 58. Depending on the size of the gyratory crusher 10, the mounting system may have from one to five mounting pegs 58 per spider arm guard 56.

The mounting pegs 58, 58' may take a variety of shapes and sizes. For example, they could have a circular, square, or triangular cross-section. The diameter of the mounting pets 58 can vary depending on the size of the gyratory crusher 10. Typical diameters would be from one and a half to four inches. The length of the mounting pegs 58 is generally approximately two to three times the diameter, or approximately three to twelve inches depending on the material. However, this ratio may vary depending on the structure of the crusher 10. For example, in the preferred embodiment of mounting pegs 58' for rim liner segment 59, the length is only about 1.5 times the diameter. The mounting pegs 58, 58' can be constructed of steel, ceramic, or other materials that would withstand the wear and tear of normal operation.

In an alternative embodiment, the mounting pegs 58 could extend upward from the spider arms 52 rather than downward from the spider arm guards 56. The spider arm guards 56 could then be manufactured with recesses sized to fit the mounting pegs 58.

The spider arm guard 56 may be lifted off the spider arm 52 for service without detaching any bolts or spring mechanisms. Therefore, the required labor for service is reduced without sacrificing the operational effectiveness of the machine overall. The method of initial assembly or repair of a spider arm guard 56 is straightforward. The guard 56 must be aligned with the spider arm 52 such that the mounting pegs 58 will fit into the corresponding recesses 60. The spider arm guard 56 may then be lowered onto the spider arm 52. Removal of a spider arm guard 56 for service may be accomplished by lifting the guard 56 off the spider arm 52.

The rim liner segment 59 shown in FIG. 4 may use the mounting peg arrangement discussed above as well. Circumferentially spaced recesses 60 are located in the spider rim 53. A typical number of mounting pegs 58' would be two per rim liner segment 59, if six segments 59 are used to protect the spider rim 53. As discussed above, alternative embodiments include extending mounting pegs upward from the spider rim 53, and using different numbers of pegs per rim liner segment 59 and altering the shapes of the pegs.

The above arrangement solves the longstanding problems discussed in the Background of the Invention section because no bolts or springs are required to maintain the spider arm guards 56 on the spider arms 52 or the rim liner segment 59 on the spider rim 53. The mounting pegs 58, 58' maintain the placement of the spider arm guards 56 and rim liner segments 59. This arrangement therefore will save time and expense when the spider arm guards 56 and rim liner segments 59 must be replaced due to wear and tear because the guards are more easily removed and installed.

While several embodiments of the invention have been described, it should be apparent to those skilled in the art that what has been described is considered at present to be the preferred embodiments of a spider arm guard 56 and rim or hopper liner 57 and method of installation. However, in accordance with the patent statutes, changes may be made in the design without actually departing from the true spirit and scope of this invention. The following claims are intended to cover all such changes and modifications which fall within the true spirit and scope of this invention.

What is claimed is:

1. A gyratory crusher, comprising:

a shell;

a spider supported by the shell, the spider having a plurality of spider arms;

a plurality of spider arm guards mounted on top of the spider arms; and mounting means rigid with and extending downwardly from each of the spider arm guards and being freely received in upwardly open recesses or apertures in the spider arms, wherein the spider arm guards are mounted to the spider in the absence of separate fasteners.

2. The gyratory crusher of claim 1 wherein the mounting means includes mounting pegs integrally formed with an underside of the spider arms guards facing the spider.

3. The gyratory crusher of claim 2 wherein two mounting pegs extend from each spider arm guard.

4. The gyratory crusher of claim 1 wherein the spider arm guards are ceramic.

5. The gyratory crusher of claim 1 wherein the spider arm guards are steel.

6. The gyratory crusher of claim 2 wherein the mounting pegs have a length between approximately three and twelve inches and a diameter between approximately one and four inches.

7. A gyratory crusher, comprising:

a shell;

a spider supported by the shell, the spider having a plurality of spider arms; and a plurality of spider arm guards mounted on top of the spider arms;

an attachment system for mounting each spider arm guard on the respective spider arm, the attachment system comprising a mounting peg fixed on one of the guard and the arm and received in an aperture or recess formed in the other of the guard and the arm to prevent lateral movement of the guard with respect to the arm and permit the guard to be freely liftable off the arm.

8. The gyratory crusher of claim 7, wherein the spider includes an annular spider rim along an outer periphery thereof, rim liner segments mounted on top of, and extending around, the spider rim; each rim liner segment including mounting means extending outward from each rim liner segment and received in circumferentially spaced recesses or apertures in the spider rim.

9. The gyratory crusher of claim 7 wherein the mounting pegs extend from each spider arm.

10. The gyratory crusher of claim 7 wherein the mounting pegs are integrally formed with the spider arm guards.

11. The gyratory crusher of claim 10 wherein the spider arm guards are ceramic.

12. The gyratory crusher of claim 7 wherein the mounting pegs are steel.

13. The gyratory crusher of claim 7 wherein the mounting pegs have a length between approximately three and twelve inches and a diameter between approximately one and four inches.

14. A gyratory crusher, comprising:

a shell;

a spider supported by the shell, the spider having an annular spider rim along an outer periphery thereof;

a plurality of rim liner segments mounted on top of, and extending around, the spider rim; and mounting means extending outward from each of the rim liner segments and being received in recesses or apertures in the spider rim.

15. The gyratory crusher of claim 14 wherein the mounting means includes mounting pegs integrally formed with the rim liner segments.

16. The gyratory crusher of claim 15 wherein two mounting pegs extend from each rim liner segment.

17. The gyratory crusher of claim 14 wherein the rim liner segments are ceramic.

18. The gyratory crusher of claim 14 wherein the rim liner segments are steel.

19. The gyratory crusher of claim 15 wherein the mounting pegs have a length between approximately three and twelve inches and a diameter between approximately one and four inches.

* * * * *